US006279418B1

(12) United States Patent
Olive, Jr.

(10) Patent No.: US 6,279,418 B1
(45) Date of Patent: Aug. 28, 2001

(54) CLUTCH DEPRESSING TOOL

(76) Inventor: Johnny L. Olive, Jr., 667 Telfair Ct., Suwanee, GA (US) 30024

( * ) Notice: Subject to any disclaimer, the term of this patent is extended or adjusted under 35 U.S.C. 154(b) by 0 days.

(21) Appl. No.: 09/453,631

(22) Filed: Dec. 3, 1999

(51) Int. Cl.[7] ..... G05G 5/18

(52) U.S. Cl. ..... 74/532; 74/527; 254/DIG. 5; 248/354.6; 403/104

(58) Field of Search ..... 74/527, 532; 248/354.1, 248/354.5, 354.6, 354.7; 188/352; 403/104

(56) References Cited

U.S. PATENT DOCUMENTS

| | | | | |
|---|---|---|---|---|
| D. 306,253 | | 2/1990 | Solow . | |
| 1,455,617 | * | 5/1923 | Jackson | 74/532 |
| 1,967,998 | | 7/1934 | Franke et al. . | |
| 2,171,832 | * | 9/1939 | Hoeppner | 254/DIG. 5 X |
| 2,662,728 | * | 12/1953 | Hanes et al. | 254/DIG. 5 X |
| 2,716,336 | | 8/1955 | Ross . | |
| 2,960,885 | * | 11/1960 | Donaldson | 74/532 X |
| 3,435,646 | | 4/1969 | Michnoff . | |
| 3,550,409 | | 12/1970 | Pariser . | |
| 4,696,172 | | 9/1987 | Farrow . | |
| 5,012,689 | * | 5/1991 | Smith | 254/DIG. 5 X |
| 5,417,127 | * | 5/1995 | Bueti et al. | 74/532 |
| 6,131,712 | * | 10/2000 | Rhodenizer | 188/352 |

* cited by examiner

*Primary Examiner*—Allan D. Herrmann

(57) ABSTRACT

A clutch depressing tool for holding a clutch pedal in an engaged position while work is performed on the clutch system. The clutch depressing tool includes a bar extending between the steering wheel and the clutch pedal. The bar has a first end and a second end. A clutch pedal engaging bracket is fixedly mounted to the first end of the bar. The clutch pedal engaging bracket has a hook portion thereon, which opens away from the bar. The hook portion is adapted to rest over an upper edge of the clutch pedal. A steering wheel engaging bracket for resting the second end of the bar on the steering wheel has a generally J-shaped configuration. The steering wheel engaging bracket has a long portion and a hook portion. The long portion has a first bore therein. The first bore has a shape adapted to slidably receive a portion of the bar. A plurality of notches for holding the steering wheel bracket is in the bar. A locking means for locking the steering wheel bracket in selective position on the bar is mounted on the steering wheel engaging bracket. The locking means is adapted to selectively engage the notches.

10 Claims, 2 Drawing Sheets

CLUTCH DEPRESSING TOOL

BACKGROUND OF THE INVENTION

1. Field of the Invention

The present invention relates to tools and more particularly pertains to a new clutch depressing tool for holding a clutch pedal in an engaged position while work is performed on the clutch system.

2. Description of the Prior Art

The use of tools is known in the prior art. More specifically, tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,696,172; U.S. Pat. No. 1,967,998; U.S. Pat. No. 3,550,409; U.S. Pat. No. 3,435,646; U.S. Pat. No. 2,716,336; and U.S. Patent Des. No. 306,253.

While these devices fulfill their respective, particular objectives and requirements, the aforementioned patents do not disclose a new clutch depressing tool. The inventive device includes a bar extending between the steering wheel and the clutch pedal. The bar has a first end and a second end. A clutch pedal engaging bracket is fixedly mounted to the first end of the bar. The clutch pedal engaging bracket has a hook portion thereon, which opens away from the bar. The hook portion is adapted to rest over an upper edge of the clutch pedal. A steering wheel engaging bracket for resting the second end of the bar on the steering wheel has a generally J-shaped configuration. The steering wheel engaging bracket has a long portion and a hook portion. The long portion has a first bore therein. The first bore has a shape adapted to slidably receive a portion of the bar. A plurality of notches for holding the steering wheel bracket are in the bar. A locking means for locking the steering wheel bracket in selective position on the bar is mounted on the steering wheel engaging bracket. The locking means is adapted to selectively engage the notches.

In these respects, the clutch depressing tool according to the present invention substantially departs from the convertional concepts and designs of the prior art, and in so doing provides an apparatus primarily developed for the purpose of holding a clutch pedal in an engaged position while work is performed en the clutch system.

SUMMARY OF THE INVENTION

In view of the foregoing disadvantages inherent in the known types of tools now present in the prior art, the present invention provides a new clutch depressing tool construction wherein the same can be utilized for holding a clutch pedal in an engaged position while work is performed on the clutch system.

The general purpose of the present invention, which will be described subsequently in greater detail, is to provide a new clutch depressing tool apparatus and method which has many of the advantages of the tools mentioned heretofore and many novel features that result in a new clutch depressing tool which is not anticipated, rendered obvious, suggested, or even implied by any of the prior art tools, either alone or in any combination thereof.

To attain this, the present invention generally comprises a bar extending between the steering wheel and the clutch pedal. The bar has a first end and a second end. A clutch pedal engaging bracket is fixedly mounted to the first end of the bar. The clutch pedal engaging bracket has a hook portion thereon, which opens away from the bar. The hook portion is adapted to rest over an upper edge of the clutch pedal. A steering wheel engaging bracket for resting the second end of the bar on the steering wheel has a generally J-shaped configuration. The steering wheel engaging bracket has a long portion and a hook portion. The long portion has a first bore therein. The first bore has a shape adapted to slidably receive a portion of the bar. A plurality of notches for holding the steering wheel bracket are in the bar. A locking means for locking the steering wheel bracket in selective position on the bar is mounted on the steering wheel engaging bracket. The locking means is adapted to selectively engage the notches.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clutch depressing tool apparatus and method which has many of the advantages of the tools mentioned heretofore and many novel features that result in a new clutch depressing tool which is not anticipated, rendered obvious, suggested, or even implied by any of the prior art tools, either alone or in any combination thereof.

It is another object of the present invention to provide a new clutch depressing tool which may be easily and efficiently manufactured and marketed.

It is a further object of the present invention to provide a new clutch depressing tool which is of a durable and reliable construction.

An even further object of the present invention is to provide a new clutch depressing tool which is susceptible of a low cost of manufacture with regard to both materials and labor, and which accordingly is then susceptible of low prices of sale to the consuming public, thereby making such clutch depressing tool economically available to the buying public.

Still yet another object of the present invention is to provide a new clutch depressing tool which provides in the apparatuses and methods of the prior art some of the advantages thereof, while simultaneously overcoming some of the disadvantages normally associated therewith.

Still another object of the present invention is to provide a new clutch depressing tool for holding a clutch pedal in an engaged position while work is performed on the clutch system.

Yet another object of the present invention is to provide a new clutch depressing tool which includes a bar extending between the steering wheel and the clutch pedal. The bar has a first end and a second end. A clutch pedal engaging bracket is fixedly mounted to the first end of the bar. The clutch pedal engaging bracket has a hook portion thereon, which opens away from the bar. The hook portion is adapted to rest over an upper edge of the clutch pedal. A steering wheel engaging bracket for resting the second end of the bar on the steering wheel has a generally J-shaped configuration. The steering wheel engaging bracket has a long portion and a hook portion. The long portion has a first bore therein. The first bore has a shape adapted to slidably receive a portion of the bar. A plurality of notches for holding the steering wheel bracket is in the bar. A locking means for locking the steering wheel bracket in selective position on the bar is mounted on the steering wheel engaging bracket. The locking means is adapted to selectively engage the notches.

Still yet another object of the present invention is to provide a new clutch depressing tool that allows a mechanic to safely engage the clutch pedal while performing mechanical repairs to the clutch without the need of an additional person to depress the clutch pedal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
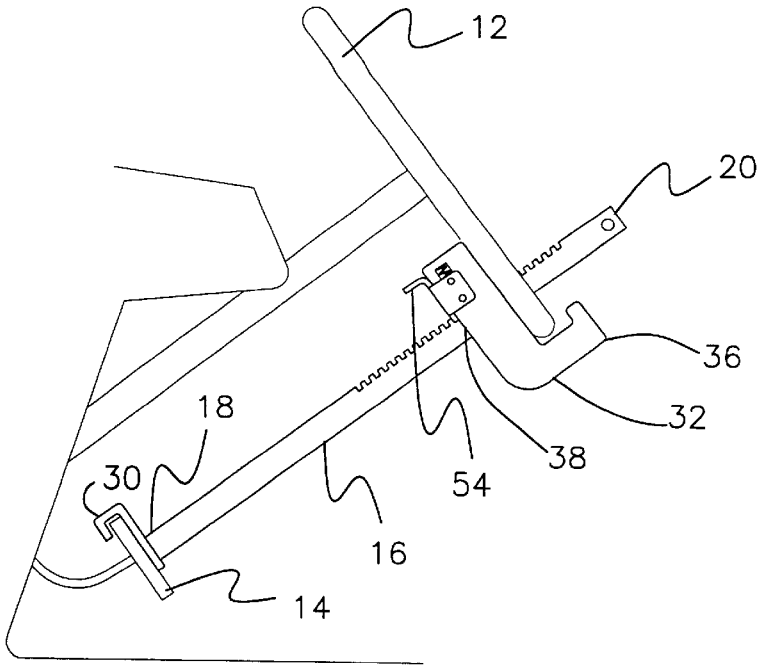
FIG. 1 is a schematic side view of a new clutch depressing tool according to the present invention.
Figure 2:
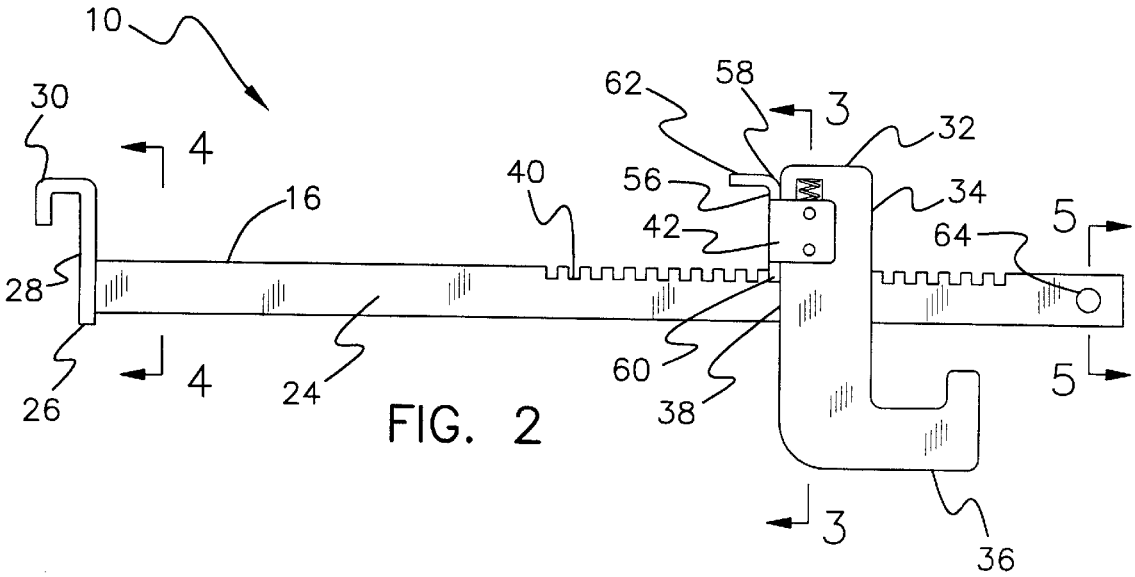
FIG. 2 is a schematic side view of the present invention.
Figure 3:
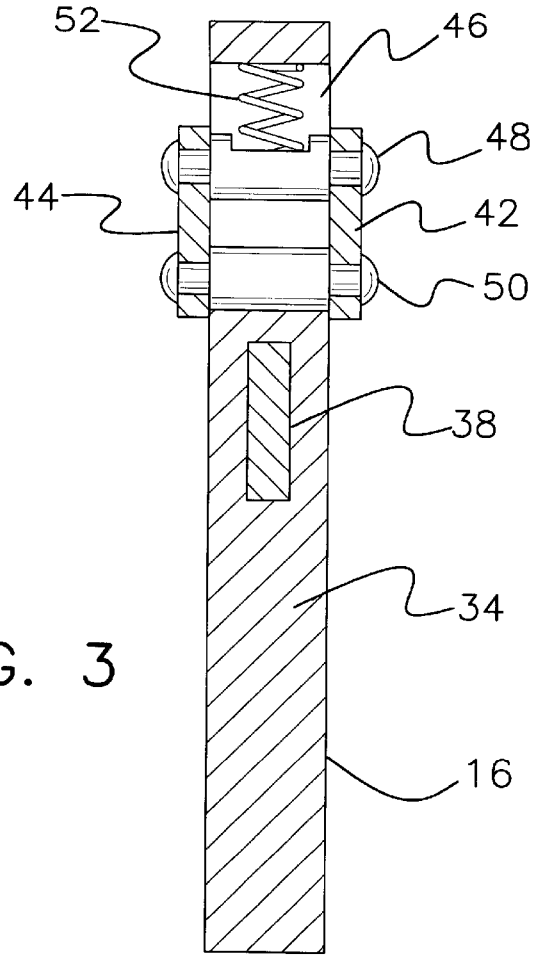
FIG. 3 is a schematic cross-sectional view taken along line 3—3 of the steering wheel engaging bracket of the present invention.
Figure 4:
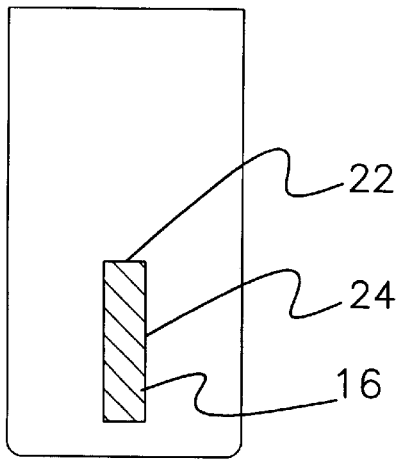
FIG. 4 is a schematic cross-sectional view taken along line 4—4 of the present invention.
Figure 5:
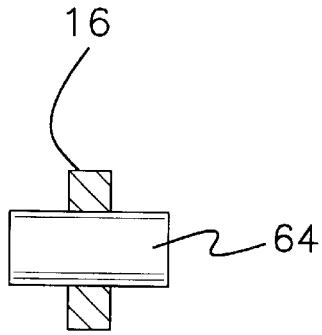
FIG. 5 is a schematic cross-sectional view taken along line 5—5 of the stop of the present invention.

With reference now to the drawings, and in particular to FIGS. 1 through 5 thereof, a new clutch depressing tool embodying the principles and concepts of the present invention and generally designated by the reference numeral 10 will be described.

As best illustrated in FIGS. 1 through 5, the clutch depressing tool 10 generally comprises a clutch depressing tool for depressing the clutch of a vehicle during repairs to a transmission of the vehicle. The vehicle has a steering wheel 12 located generally above the clutch pedal 14.

A bar 16 for extending between the steering wheel 12 and the clutch pedal 14 is elonate and has a first end 18 and a second end 20. The bar 16 has a generally rectangular cross-section taken transverse to a longitudinal axis of the bar. The bar has a top face 22 and two side faces 24.

A clutch pedal engaging bracket 26 removably mounts the first end 18 of the bar 16 on the clutch pedal 14. The clutch pedal engaging bracket 26 is fixedly mounted to the first end 18 of the bar 16. The clutch pedal engaging bracket 26 has a generally J-shaped configuration. The clutch pedal engaging bracket has a long portion 28 and a hook portion 34). The long portion 28 has a longitudinal axis oriented perpendicular to the longitudinal axis of the bar 16. The hook portion 30 opens away from the bar 16 and is adapted to rest over an upper edge of the pedal 14 of the clutch to resist slippage of the hook portion off of the pedal. The hook portion 30 is directed downward when in use.

A steering wheel engaging bracket 32 rests the second end 20 of the bar 18 on the steering wheel 12. The steering wheel engaging bracket 32 has a generally J-shaped configuration. The steering wheel engaging bracket has a long portion 34 and a hook portion 36. The long portion 34 has a first bore therein 38. The first bore 28 has a shape adapted to slidably receive a portion of the bar 16. The first bore 38 is located in the long portion 34 such that the hook portion 36 of the steering wheel engaging bracket is directed in an opposite direction of the hook portion 30 of the clutch pedal engaging bracket 26. A portion of the steering wheel 12 rests between the hook portion 36 of the steering wheel engagement bracket 32 and the bar 16. The hook portion 36 of the steering wheel engaging bracket 32 is directed upward when in use.

A plurality of notches 40 holds and secures the steering wheel bracket 32. The notches 40 are in the top face 22 of the bar 16 and are generally located between a longitudinal midpoint of the bar and the second end 20 of the bar 16.

A locking means locks the steering wheel engagement bracket 32 in selective positions on the bar 16. The locking means has a first 42 and second plate 44. Each of the plates 42, 44 is slidably mounted to an opposite side of the steering wheel bracket 32. Each of the plates 42, 44 has a plane oriented generally parallel to a plane of one of the side faces 24 of the bar 16. The plates 42, 44 extend away from the steering wheel engagement bracket 32 toward the first end 18 of the bar 16 to define two spaced ends.

A second bore 46 in the steering wheel engaging bracket mounts 32 the first 42 and second plates 44 to the steering wheel engaging bracket 32. The second bore 46 is located in the steering wheel engaging bracket 32 generally between the first 42 and the second plates 44.

A first pin 48 and a second pin 50 extend through the second bore 46. Each of the pins 48, 50 is fixedly coupled to the first 42 and second 44 plates. The second pin 50 is between the first pin 48 and the bar 16.

A spring 52 urges the plates 42, 44 toward the bar 16. The spring 52 is mounted in the second bore 50, and is biased against the first pin 42, wherein the first pin 42 is urged toward the bar 16.

A pawl 54 selectively engages the notches 40. The pawl 54 has a first arm 56 having a first end 58 and a second end 60. The first arm 56 is fixedly mounted to and between the spaced ends of the first 42 and second plate 44. The first arm 56 is oriented generally perpendicular to the longitudinal axis of the bar. The pawl 54 has a second arm 62. The second arm 62 is fixedly coupled to the first end 58 of the first arm 54. The second arm 62 is oriented generally perpendicular to the first arm 56. The second end 60 of the first arm 56 of the pawl 54 selectively engages the notches 40. Pulling the second arm 62 compresses the spring 52 such that the second end 60 of the first arm 56 is released from the notches 40.

Preferably, a stop 64 prevents the steering wheel engagement bracket 32 from sliding off of the bar 16. The stop 64 is generally adjacent to the second end 20 of the bar 16. Ideally, the stop 64 is a pin extending through and away from both sides of the bar 16.

In use, the bar 16 is placed on the inside surface of the steering wheel 12. The clutch pedal engaging bracket 26 is placed over the edge of the clutch pedal 14. The pawl 54 is lifted and the steering wheel engaging bracket 32 is slid up the bar 16 to rest against the steering wheel 12 and to press the clutch pedal 14 downward. When the clutch pedal 14 is completely engaged, the pawl 54 is released to hold the steering wheel engagement bracket 32 in place.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clutch depressing tool for depressing the clutch of a vehicle during repairs to a transmission of the vehicle, the vehicle having a steering wheel located generally above the clutch pedal, the tool comprising:

a bar for extending between the steering wheel and the clutch pedal, said bar having a first end and a second end;

a clutch pedal engaging bracket, said clutch pedal engaging bracket being fixedly mounted to said first end of said bar, said clutch pedal engaging bracket having a hook portion thereon, said hook portion opening away from said bar, wherein said hook portion is adapted to rest over an upper edge of the clutch pedal;

a steering wheel engaging bracket for resting said second end of said bar on the steering wheel, said steering wheel engaging bracket having a generally J-shaped configuration, wherein said steering wheel engaging bracket has a long portion and a hook portion, said long portion having a first bore therein, said first bore having a shape adapted to slidably receive a portion of said bar;

a plurality of notches for holding said steering wheel bracket, said notches being in said bar; and a locking means for locking said steering wheel engagement bracket in selective position on said bar, said locking means being mounted on said steering wheel engaging bracket, said locking means being adapted to selectively engage said notches;

a stop for preventing said steering wheel engagement bracket from sliding off of said bar, said stop being generally adjacent to said bar, said stop being a pin extending through both sides of said bar.

2. The clutch depressing tool as in claim 1, wherein said tool comprises:

said bar having a generally rectangular cross-section taken transverse to a longitudinal axis of said bar, said bar having a top face and two side faces; and said clutch pedal engaging bracket having a generally J-shaped configuration, wherein said clutch pedal engaging bracket has a long portion and said hook portion, said long portion having a longitudinal axis oriented perpendicular to said longitudinal axis of said bar.

3. The clutch depressing tool as in claim 1, wherein said steering wheel engaging bracket comprises:

said first bore being located in said first portion such that said hook portion of said steering wheel engaging bracket is directed in an opposite direction of said hook portion of said clutch pedal engaging bracket, a portion of the steering wheel resting between said hook portion of said steering wheel engagement bracket and said bar, said hook portion of said steering wheel engaging bracket being directed upward when in use.

4. The clutch depressing tool as in claim 2, wherein said notches comprise:

said notches being in said top face of said bar, said notches being generally located between a longitudinal midpoint of said bar and said second end of said bar.

5. The clutch depressing tool as in claim 4, said locking means comprising:

a first plate and a second plate, each of said plates being slidably mounted to an opposite side of said steering wheel engagement bracket, each of said plates having a plane oriented generally parallel to a plane of one of said side faces of said bar, each of said plates extending away from said steering wheel engagement bracket toward said first end of said bar to define two spaced ends;

a second bore in said steering wheel engaging bracket for mounting said first and second plates;

at least one pin, said pin extending through said second bore, said pin being fixedly coupled to said first and second plates;

a spring, for urging said plates toward said bar, said spring being mounted in said second bore, said spring being biased against said pin, wherein said pin is urged toward said bar;

a pawl for selectively engaging said notches, said pawl being fixedly mounted to and between said spaced ends of said first and second plate.

6. The clutch depressing tool as in claim 5, further comprising a stop for preventing said steering wheel engagement bracket from sliding off of said bar, said stop being generally adjacent to said second end of said bar.

7. A clutch depressing tool for depressing the clutch of a vehicle during repairs to a transmission of the vehicle, the vehicle having a steering wheel located generally above the clutch pedal, the tool comprising:

a bar for extending between the steering wheel and the clutch pedal, said bar being elongate, said bar having a first end and a second end, said bar having a generally rectangular cross-section taken transverse to a longitudinal axis of said bar, said bar having a top face and two side faces;

a clutch pedal engaging bracket for removably mounting said first end of said bar on the clutch pedal, said clutch pedal engaging bracket being fixedly mounted to said first end of said bar, said clutch pedal engaging bracket having a generally J-shaped configuration, wherein said clutch pedal engaging bracket has a long portion and a hook portion, said long portion having a lonigitudinal axis oriented perpendicular to said longitudinal axis of said bar, said hook portion opening away from said bar, wherein said hook portion is adapted to rest over an upper edge of the pedal of the clutch to resist slippage of said hook portion off of said pedal, wherein said hook portion is directed downward when in use;

a steering wheel engaging bracket for resting said second end of said bar on the steering wheel, said steering wheel engaging bracket having a generally J-shaped configuration, wherein said steering wheel engaging bracket has a long portion and a hook portion, said long portion having a first bore therein, said first bore having a shape adapted to slidably receive a portion of said bar, said first bore being located in said long portion such that said hook portion of said steering wheel engaging bracket is directed in an opposite direction of said hook portion of said clutch pedal engaging bracket, wherein a portion of the steering wheel rests between said hook portion of said steering wheel engagement bracket and said bar, wherein said hook portion of said steering wheel engaging bracket is directed upward when in use;

a plurality of notches for holding said steering wheel bracket, said notches being in said top face of said bar, said notches being generally located between a longitudinal midpoint of said bar and said second end of said bar;

a locking means for locking said steering wheel engagement bracket in selective position on said bar, said locking means comprising:

a first plate and a second plate, each of said plates being slidably mounted to an opposite side of said steering wheel engagement bracket, each of said plates having a plane oriented generally parallel to a plane of one of said side faces of said bar, each of said plates extending away from said steering wheel engagement bracket toward said first end of said bar to define two spaced ends;

a second bore in said steering wheel engaging bracket for mounting said first and second plates, said second bore being located in said steering wheel engaging bracket generally between said first and said second plates;

a first pin and a second pin, each of said pins extending through said second bore, each of said pins being fixedly coupled to said first and second plates, wherein said second pin is between said first pin and said bar;

a spring for urging said plates toward said bar, said spring being mounted in said second bore, said spring being biased against said first pin, wherein said first pin is urged toward said bar;

a pawl for selectively engaging said notches, said pawl having a first arm, said first arm having a first end and a second end, said first arm being fixedly mounted to and between said spaced ends of said first and second plate, said first arm being oriented generally perpendicular to said longitudinal axis of said bar, said pawl having a second arm, said second arm being fixedly coupled to said first end of said first arm, said second arm being oriented generally perpendicular to said first arm;

wherein said second end of said first arm of said pawl selectively engages said notches, wherein pulling said second arm compresses said spring such that said second end of said first arm is released from said notches; and a stop for preventing said steering wheel engagement bracket from sliding off of said bar, said stop being generally adjacent to said second end of said bar, said stop being a pin, said pin extending through and away from both sides of said bar.

8. A clutch depressing tool for depressing the clutch of a vehicle during repairs to a transmission of the vehicle, the vehicle having a steering wheel located generally above the clutch pedal, the tool comprising:

a bar for extending between the steering wheel and the clutch pedal, said bar having a first end and a second end;

a clutch pedal engaging bracket, said clutch pedal engaging bracket being fixedly mounted to said first end of said bar, said clutch pedal engaging bracket having a hook portion thereon, said hook portion opening away from said bar, wherein said hook portion is adapted to rest over an upper edge of the clutch pedal;

a steering wheel engaging bracket for resting said second end of said bar on the steering wheel, said steering wheel engaging bracket having a generally J-shaped configuration, wherein said steering wheel engaging bracket has a long portion and a hook portion, said long portion having a first bore therein, said first bore having a shape adapted to slidably receive a portion of said bar;

a plurality of notches for holding said steering wheel bracket, said notches being in said bar; and a locking means for locking said steering wheel engagement bracket in selective position on said bar, said locking means being mounted on said steering wheel engaging bracket, said locking means being adapted to selectively engage said notches;

a stop for preventing said steering wheel engagement bracket from sliding off of said bar, said stop being generally adjacent to said bar, said stop being a pin extending through both sides of said bar;

said clutch pedal engaging bracket having a generally J-shaped configuration, wherein said clutch pedal engaging bracket has a long portion and said hook portion, said long portion having a longitudinal axis oriented perpendicular to said longitudinal axis of said bar;

said notches being in said top face of said bar, said notches being generally located between a longitudinal midpoint of said bar and said second end of said bar;

a first plate and a second plate, each of said plates being slidably mounted to an opposite side of said steering wheel engagement bracket, each of said plates having a plane oriented generally parallel to a plane of one of said side faces of said bar, each of said plates extending away from said steering wheel engagement bracket toward said first end of said bar to define two spaced ends;

a second bore in said steering wheel engaging bracket for mounting said first and second plates;

at least one pin, said pin extending through said second bore, said pin being fixedly coupled to said first and second plates;

a spring for urging said plates toward said bar, said spring being mounted in said second bore, said spring being biased against said pin, wherein said pin is urged toward said bar;

a pawl for selectively engaging said notches, said pawl being fixedly mounted to and between said spaced ends of said first and second plate.

9. The clutch depressing tool as in claim 8, further comprising:

a stop for preventing said steering wheel engagement bracket from sliding off of said bar, said stop being generally adjacent to said second end of said bar.

10. The clutch depressing tool as in claim 8, wherein said steering wheel engaging bracket comprises:

said first bore being located in said first portion such that said hook portion of said steering wheel engaging bracket is directed in an opposite direction of said hook portion of said clutch pedal engaging bracket, a portion of the steering wheel resting between said hook portion of said steering wheel engagement bracket and said bar, said hook portion of said steering wheel engaging bracket being directed upward when in use.

* * * * *